US009722325B2

(12) United States Patent
Svendsen et al.

(10) Patent No.: US 9,722,325 B2
(45) Date of Patent: Aug. 1, 2017

(54) ANTENNA CONFIGURATION WITH COUPLER(S) FOR WIRELESS COMMUNICATION

(71) Applicant: Intel IP Corporation, Santa Clara, CA (US)

(72) Inventors: Simon Svendsen, Aalborg (DK); Ole Jagielski, Frederikshavn (DK); Boyan Yanakiev, Aalborg (DK); Farooq Shaikh, Aalborg (DK)

(73) Assignee: Intel IP Corporation, Santa Clara, CA (US)

( * ) Notice: Subject to any disclaimer, the term of this patent is extended or adjusted under 35 U.S.C. 154(b) by 125 days.

(21) Appl. No.: 14/670,650

(22) Filed: Mar. 27, 2015

(65) Prior Publication Data

US 2016/0285173 A1 Sep. 29, 2016

(51) Int. Cl.

| | |
|---|---|
| ***H01Q 21/28*** | (2006.01) |
| ***H01Q 1/52*** | (2006.01) |
| ***H01Q 7/00*** | (2006.01) |
| ***H01Q 5/328*** | (2015.01) |
| ***H01Q 5/385*** | (2015.01) |
| *H01Q 1/24* | (2006.01) |
| *H01Q 21/30* | (2006.01) |

(52) U.S. Cl.

CPC ..... *H01Q 21/28* (2013.01); *H01Q 1/521* (2013.01); *H01Q 5/328* (2015.01); *H01Q 5/385* (2015.01); *H01Q 7/00* (2013.01); *H01Q 1/243* (2013.01); *H01Q 21/30* (2013.01)

(58) Field of Classification Search

CPC ..... H01Q 21/28; H01Q 5/10; H01Q 5/30
USPC ..... 343/893, 702
See application file for complete search history.

(56) References Cited

U.S. PATENT DOCUMENTS 7,315,289 B2 * 1/2008 Puente Baliarda ..... H01Q 1/36 343/817
7,339,531 B2 * 3/2008 Desclos ..... H01Q 1/38 343/700 MS
7,425,924 B2 * 9/2008 Chung ..... H01Q 1/38 343/702

(Continued)

FOREIGN PATENT DOCUMENTS

WO 2011031668 A1 3/2011

OTHER PUBLICATIONS

Y.-C. Lee, et al.; "Compact Printed Slot Antennas for Wireless Dual- And Multi-Band Operations"; Progress in Electromagnetics Research, PIER 88, 2008, p. 289-305.

*Primary Examiner* — Huedung Mancuso
(74) *Attorney, Agent, or Firm* — Eschweiler & Potashnik, LLC

(57) ABSTRACT

A cellular low band antenna is indirectly coupled to communication signals via a first coupler that is located within a same volume of a body as one or more wireless local area network (WLAN) antennas. Various antenna configurations can include the one or more WLAN antennas being indirectly coupled to communication signals via a second coupler within the same volume as the cellular low band antenna. A high band antenna is located in a different volume that is adjacent to the volume of the cellular low band antenna and the one or more WLAN antennas. Another similar antenna system can be provided in a separate volume for diversity communications in a communication device, such as a tablet, laptop or other such communication device.

21 Claims, 7 Drawing Sheets

(56) References Cited

U.S. PATENT DOCUMENTS

| | | | | |
|---|---|---|---|---|
| 8,547,283 | B2 * | 10/2013 | Wong | H01Q 1/243 343/700 MS |
| 9,437,925 | B2 * | 9/2016 | Wong | H01Q 5/371 |
| 2003/0098812 | A1 * | 5/2003 | Ying | H01Q 1/243 343/702 |
| 2005/0001769 | A1 * | 1/2005 | Qi | H01Q 1/243 343/700 MS |
| 2005/0280579 | A1 * | 12/2005 | Liang | H01Q 1/38 343/700 MS |
| 2009/0273531 | A1 * | 11/2009 | Ishizuka | H01Q 1/243 343/750 |
| 2012/0274538 | A1 * | 11/2012 | Tsou | H01Q 1/243 343/876 |

* cited by examiner

ANTENNA CONFIGURATION WITH COUPLER(S) FOR WIRELESS COMMUNICATION

FIELD

The present disclosure is in the field of wireless communications, and more specifically, pertains to an antenna configuration with one or more couplers for wireless communications.

BACKGROUND

The number of antennas utilized in modern wireless devices (e.g. smartphones) are increasing in order to support new cellular bands, with bands now ranging between 600 MHz to 3800 MHz, multiple-input multiple-output (MIMO), diversity, carrier aggregation, wireless local area networks (WLANs), near field communication (NFC), global navigation satellite systems (GNSS), or other radio communication technologies, for example, which poses a challenge due to the volume or space required for each antenna to achieve good performance. For example, the performance of antennas in mobile devices is (among others) related to the volume or space allocated and the physical placement in the mobile device, such as a mobile phone, for example. Increasing the allocated volume for the antenna can result in better antenna performance, for example, in terms of the reflection coefficient and/or the radiated efficiency. The width of the display is often nearly as wide as the smartphone itself, batteries take up a considerable volume inside the mobile device housing, and the available volume for antennas especially close to the outer casing of the housing is very limited and in many cases not usable for antennas also as a result of coupled interference. Other components like the USB connector, the audio jack and different user control buttons, are normally also placed at the outer casing of the housing, reducing the available volume for the antenna within the housing even more. Therefore, it is desired to provide antenna modules with low volume consumption and good performance for wireless communication devices.

DETAILED DESCRIPTION

Figure 1:
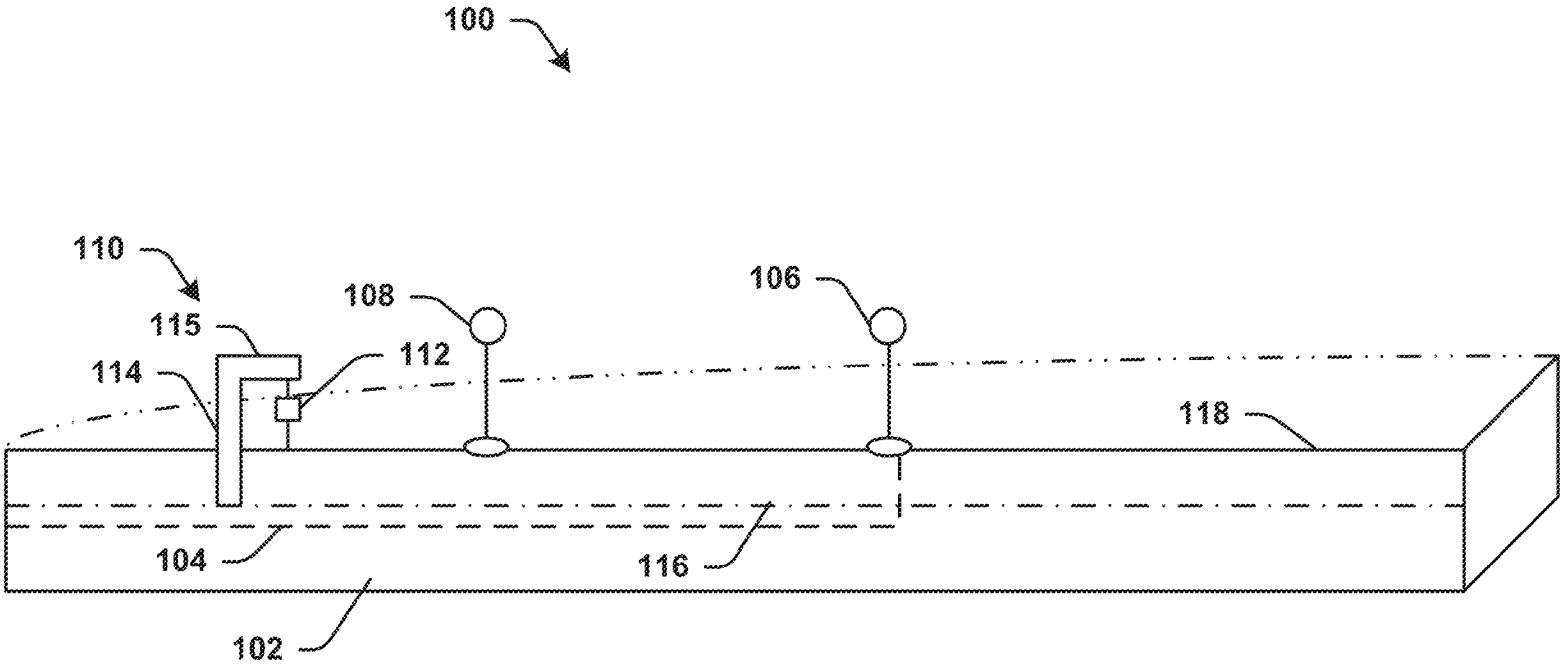
FIG. 1 is a block diagram illustrating an antenna system or device according to various aspects described.

The present disclosure will now be described with reference to the attached drawing figures, wherein like reference numerals are used to refer to like elements throughout, and wherein the illustrated structures and devices are not necessarily drawn to scale. As utilized herein, terms "component," "system," "interface," and the like are intended to refer to a computer-related entity, hardware, software (e.g., in execution), and/or firmware. For example, a component can be a processor, a process running on a processor, a controller, an object, an executable, a program, a storage device, and/or a computer with a processing device. By way of illustration, an application running on a server and the server can also be a component. One or more components can reside within a process, and a component can be localized on one computer and/or distributed between two or more computers. A set of elements or a set of other components can be described herein, in which the term "set" can be interpreted as "one or more."

Further, these components can execute from various computer readable storage media having various data structures stored thereon such as with a module, for example. The components can communicate via local and/or remote processes such as in accordance with a signal having one or more data packets (e.g., data from one component interacting with another component in a local system, distributed system, and/or across a network, such as, the Internet, a local area network, a wide area network, or similar network with other systems via the signal).

As another example, a component can be an apparatus with specific functionality provided by mechanical parts operated by electric or electronic circuitry, in which the electric or electronic circuitry can be operated by a software application or a firmware application executed by one or more processors. The one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components.

Use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form. Furthermore, to the extent that the terms "including", "includes", "having", "has", "with", or variants thereof are used in either the detailed description and the claims, such terms are intended to be inclusive in a manner similar to the term "comprising".

Introduction

A general introduction of the disclosure is provided below with more detailed embodiments and aspects being described subsequently with reference to example figures. In consideration of the above described deficiencies of radio frequency communications, various aspects for mobile devices using wireless radio communications to utilize at least one of carrier aggregation, diversity reception or transmission, reception or transmission with directional characteristics, MIMO or operations, NFC, GNSS or various other communication operations with antenna architectures including one or more coupler elements are disclosed.

Antenna performance can be compromised when bad isolation properties are present among antenna elements of an antenna system. Without good isolation, antenna elements of a system can couple to one another and thus reduce the power, reception or transmission efficiency of one another. Isolation can be straightforward, if antenna elements of a system operate on different frequencies separated by a large frequency range of operation, or are separated from one another by a sufficient distance. The antenna systems disclosed can comprise a plurality of antenna components, antenna elements or antenna ports coupled to one or more antenna components that resonant at a respective frequency within frequency ranges that can be separate, partially overlap or match, for example. The antenna architectures disclosed can comprise solutions for having a low band antenna indirectly coupled to a feed signal component via an indirect coupler substantially within a same, first volume of a body as one or more high band antennas, which can be directly fed or indirectly coupled to another feed component via another indirect coupler. Alternatively, the antenna architectures can be within different volumes of a body, in which a volume is further detailed herein and can comprise one or more portions, sections or subsets of a body (e.g., a substrate, printed circuit board, chassis or the like). An additional antenna comprising a high band antenna can also be substantially located in a second volume of the body that is substantially adjacent to the first volume of the body, or partially overlap therebetween with regular or irregular boundaries. This additional antenna can comprise a monopole resonating element that faces a parasitic resonating element and a coupler that joins the monopole resonating element and the parasitic resonating element to cover a high band frequency range and a mid-band frequency range. Other embodiments are also envisioned as one of ordinary skill in the art would appreciate, such as the monopole resonating element and the parasitic resonating element facing different directions, or the additional antenna can be an indirect fed antenna, for example.

In an aspect, a low band antenna can be substantially located within a first antenna volume of a body that comprises a circuit board and a ground plane. The antenna element can be a cellular low band antenna, for example, that can operate or resonate at a resonant frequency within a first resonant frequency range, such as about 600 MHz to about 960 MHz. A second antenna, as a first high band antenna, can be substantially located within the same first volume of the body, and can be configured to operate at a second resonant frequency range, which can comprise one of about 2400 MHz to about 2484 MHz or from about 5150 MHz to 5850 MHz, or both about 2400 MHz to about 2484 MHz and about 5150 MHz to 5850 MHz, for example.

In another aspect, a third antenna, as a second high band antenna, can also be substantially located within the same first volume of the body and be configured to operate at a frequency range that is different from the first high band antenna (e.g., WLAN antennas, cellular high band antennas, millimeter wave antennas or the like), such as at about 2400 MHz to about 2484 MHz, or from about 5150 MHz to 5850 MHz, for example, or other high band frequency ranges. In one aspect, a first coupler can indirectly couple to the first antenna element or a low band antenna element, for example, within the same volume. A second coupler can be located within the first antenna volume and configured to indirectly (electromagnetically) couple the first and second high band antenna to another feed signal component and a communication component (e.g., receiver, transmitter, transceiver or the like) for transmitting and receiving communications associated with the first antenna element. The coupler can designed to couple to both the first high band antenna and the second high band antenna, for example, which can also provide a direct or an indirectly coupling to one or both the first and second high band antennas.

In another aspect, the second coupler can operate as the second high band antenna to cover a frequency range that is different than the first high band antenna. For example, the coupler can indirectly couple to the first high band antenna and further operate to cover the higher wireless frequency range (e.g., about 5150 MHz to 5850 MHz). Different variations or related embodiments can be further envisioned as one of ordinary skill in the art would appreciate and is further detailed below. For example, the coupler can couple the first high band antenna operating in a high band frequency range (e.g., 2400 MHz to 2484 MHz) and also operate as a second high band antenna operating in a different (e.g., 5150 MHz to 5850 MHz), in place of the additionally having the second high antenna operating in about 5150 MHz to 5850 MHz, for example.

The coupler(s) disclosed in this disclosure can provide indirect connections or direct connections. An indirect coupler does not use a direct coupling e.g. a wire coupling, but instead uses e.g. electromagnetically (inductively or capacitively) coupling to an antenna element, such as an indirect coupler that couples a first antenna element to a signal feed component. The signal feed can be further coupled to a transmitter, receiver, transceiver, modem, baseband or the like communication component for further processing of communication signals. In contrast, a direct coupler directly connects to the antenna element, for example, by a wire coupling to facilitate signals received or transmitted by the antenna element along the signal feed component to the communication component (e.g., a transceiver, receiver, transmitter or the like).

In another aspect, a fourth antenna, as a high band antenna, can be located next or in close proximity to the first antenna volume and configured to operate at a fourth resonant frequency range of about 1710 MHz to about 2690 MHz, and within a same volume or portion of body. The high band antenna can be substantially located in as second volume, or a subset of the first volume, that is substantially next to the low band antenna and the first and second WLAN antennas.

In another aspect, the first volume, or the subsets of the first volume, can be designated as a main antenna volume, while an additional volume that is substantially separate from or opposite to the first volume can comprise a set of additional antennas for diversity/MIMO communications and to additionally include a mid-band frequency range with the high band frequency range from about 1300 MHz to 3800 MHz, for example. Additional aspects and details of the disclosure are further described below with reference to figures.

Example Embodiments of Antenna Configuration with Coupler(s) for Wireless Communication FIG. 1 illustrates an example of a high level system of an antenna system or device for wireless or antenna solutions to enable various different resonant elements or antenna components to operate at different frequency ranges close to one another in the same volume of a device body with one or more couplers. The system 100 can comprise a communication system or device that operates as a wireless device (e.g., a laptop, a tablet or other wireless communicating device have a processor and a memory) or comprise a wireless device for communicating with at least one of carrier aggregation, diversity reception or MIMO operations, for example. The system 100 can facilitate the operation of multiple antennas within a same edge, a same volume, a same quadrant, a same zone, a same portion or the like section of a device body 102 such as a circuit board having a ground plane 116 for the wireless device. The edge, volume, quadrant, zone, portion or like section of the device can be delineated and reside among multiple volumes, quadrants, zones, portions or like sections comprising a total volume of the device.

Figure 3:
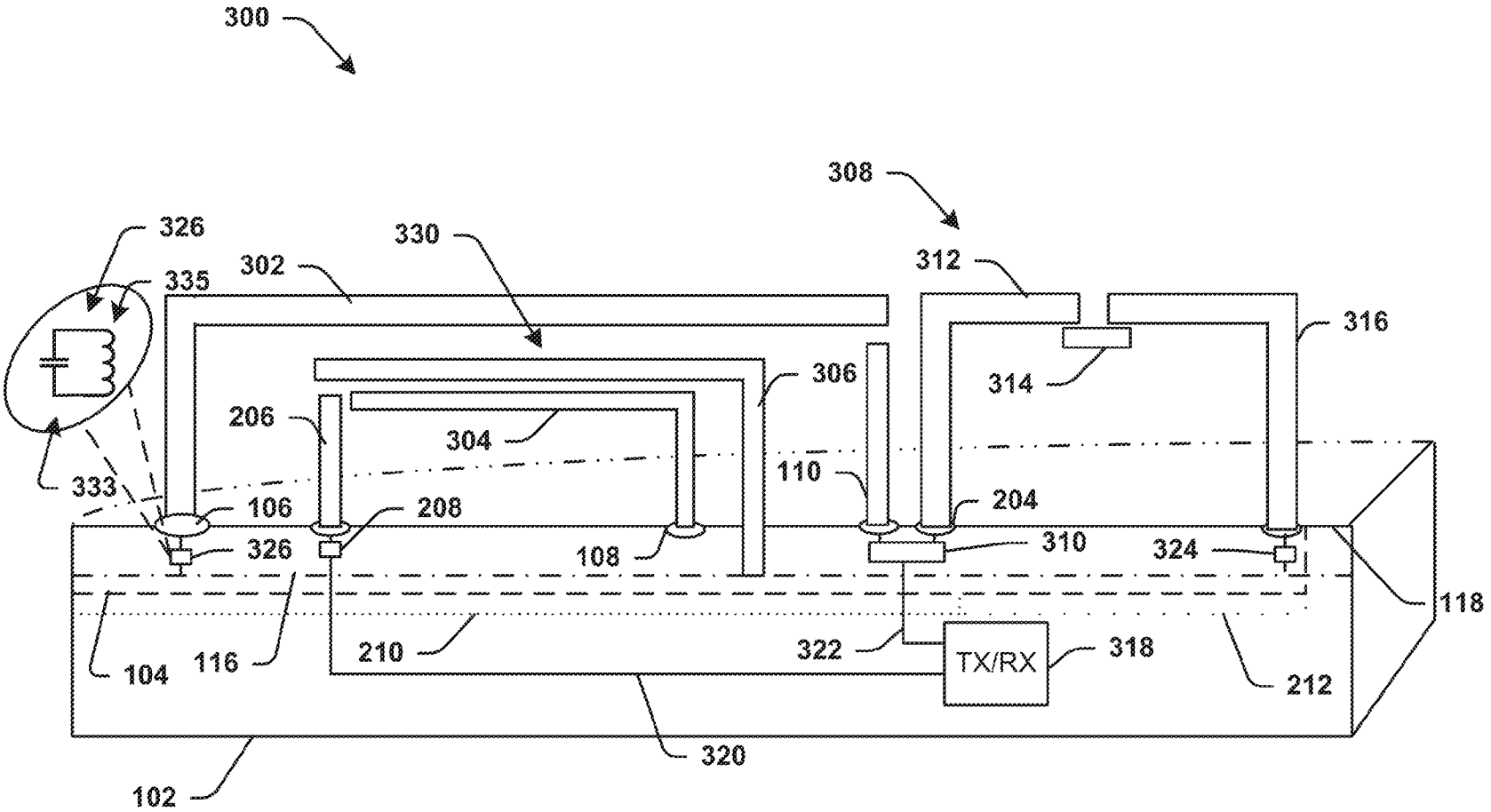
FIG. 3 is another block diagram of an antenna device according to various aspects described.

For example, a first antenna port 106 that operates in one frequency range (e.g., a low frequency range of about 600 MHz to about 960 MHz, or a subset of the low frequency range) can connect to a first antenna element (as further illustrated in FIG. 3 in detail with antenna 302, for example) and fabricated next to a second antenna port 108 that can connect to a second antenna element (as further illustrated in FIG. 3 with antenna 304, for example). The second antenna port 108 can be configured to connect to one or more antenna elements (e.g., a second or a third antenna element also illustrated and detailed below with reference to FIG. 3) that operate in one or more high band frequency ranges (e.g., about 2400 MHz to about 2484 MHz or from about 5150 MHz to 5850 MHz, for WLAN frequency ranges) within a same volume 104 as the first antenna port 106.

The second antenna port 108, for example, can connect a first WLAN antenna that resonates at a first WLAN frequency range (e.g., about 2400 MHz to about 2484 MHz), a second WLAN frequency range (e.g., about 5150 MHz to 5850 MHz), or at both the first and second WLAN frequency ranges at the same antenna element (not shown) via a single WLAN coupler, which can electromagnetically couple the WLAN antenna elements.

The volume 104 or volumes that the first and second antenna ports 106 and 108 are fabricated within, or on, can be at, or reside along, as a same portion/volume or single edge of the device, for example. These volume or volumes of the antenna ports 106 and 108 can include a body or substrate within a printed circuit board or substrate, for example. The volumes being described herein can also comprise a fraction, section, portion or less than an entire volume of the body, such as by contacting less than all edges of the device (e.g., at about two or three dimensional edges), for example.

The system 100 comprises the body 102, the first antenna volume 104, the first antenna port 106, the second antenna port 108, and a coupler 110. The body 102 can comprise a circuit board, for example, with a ground plane 116. The body 102 can include a silicon body or other materials or metals that comprise at least a portion of a mobile or wireless device. The ground plane 116 can be fabricated at least partially within, below or above the body 102 of the circuit board and be the same shape or a different shape than the body 102. The first and second antenna ports 106 and 108 can operate as ports, connection points, or unions to one or more antenna components that can operate as resonant elements for wireless communications. The first and second antenna ports 106 and 108 can be coupled to the ground plane 116 of the body 102, or the circuit board, and correspond to, or designated to resonate for particular frequencies ranges for various mobile communications of one or more different networks, as discussed above.

For example, the first antenna port 106 can be designated for a cellular low band frequency network and operate within a low frequency bandwidth for communications via a cellular high frequency network device (e.g., a base station, eNodeB device, or other network device) associated with a cellular network. Likewise, the second antenna port 108 can be designated to resonate for a Wi-Fi network, or other network, and operate for communications within the network that can be associated with a WLAN network device or a different network device (e.g., Micro network device, Pico cell network device, etc.).

The first antenna port 106 and the second antenna port 108 can be located proximate to and adjacent one another along a same edge or perimeter of a mobile device within the same volume 104 of the body 102. For example, the first antenna port 106 and the second antenna port 108 can be located adjacent to one another on a same edge 118 of a device body within a first half of the edge 118 or some other portion of a sectional volume along the edge of a mobile or wireless device. Other antenna configurations can also be envisioned according to one of ordinary skill the art, in which the first antenna port 106 and the second antenna port 108 are located next to one another in a section, portion or subset of the body 102 or a circuit board of the body 102, as well as with one or more antenna components coupled to antenna elements within a corresponding volume.

The first volume 104 can further include the coupler 110 that can operate to indirectly couple the first antenna port 106 or any antenna element coupled thereto. The coupler 110 can operate, for example, as a high impedance cellular low band coupler that indirectly couples communication signals to the first antenna port 106 at a range of low band frequencies (e.g., about 600 MHz to about 960 MHz) while directly coupling communications to other components of the wireless device, such as a feed signal component 112 for matching and a communication component, transceiver, transmitter, or receiver, for example. The coupler 110 can also be spaced adjacent to the antenna port 106 and within the same volume 104 of the circuit board body 102, such as along the same edge 118 or section of an entire volume of the body 102. For example, the volume 104 can be along a perimeter dimension or other volume of the body that can be a section of the body 102 having the first antenna port 106 and the second antenna port 108 so that the first antenna port 106, the second antenna port 108 and the coupler 110 are located in the same volume 104.

The coupler 110 can be directly coupled to a feed element 112, which can include a circuit matching element or matching component with one or more electrical elements, for example, to provide a matching impedance. The coupler 110 can further be tuned or re-tuned to affect the coupling of an antenna element at the first antenna port 106 by modification of the physical shape of the coupler element or antenna element. The feed element 112 can operate to improve a matching between a transceiver, receiver, transmitter or like communication component (not shown), and can be coupled to a transmitter, transceiver, receiver or other communication component (not shown) that operates to transmit or receive one or more communication signals (e.g., radio frequency signals) within a low band frequency range of about 600 MHz to about 960 MHz, for example. The feed element 112 can provide the input for signals between the antenna port 106, or an antenna element coupled to the antenna port 106 and a communication component (e.g., a receiver, transmitter, transceiver, or the like component) for further transmitting and receiving communication signals.

In one aspect, the coupler 110 can comprise a support structure 114 and an arm 115. The support structure 114 can reside along the same edge 118 and be configured to support the arm 115 facing inward along the same edge 118 and towards the first antenna port 106 or in other orientations, for example. Alternatively, in other embodiments, the coupler 110 can comprise different configurations as well, such as a single arm 115, or face in a different direction, for example. The coupler 110 further operates to provide a desired electromagnetic coupling between the ground plane 116 and the antenna port 106.

Figure 2:
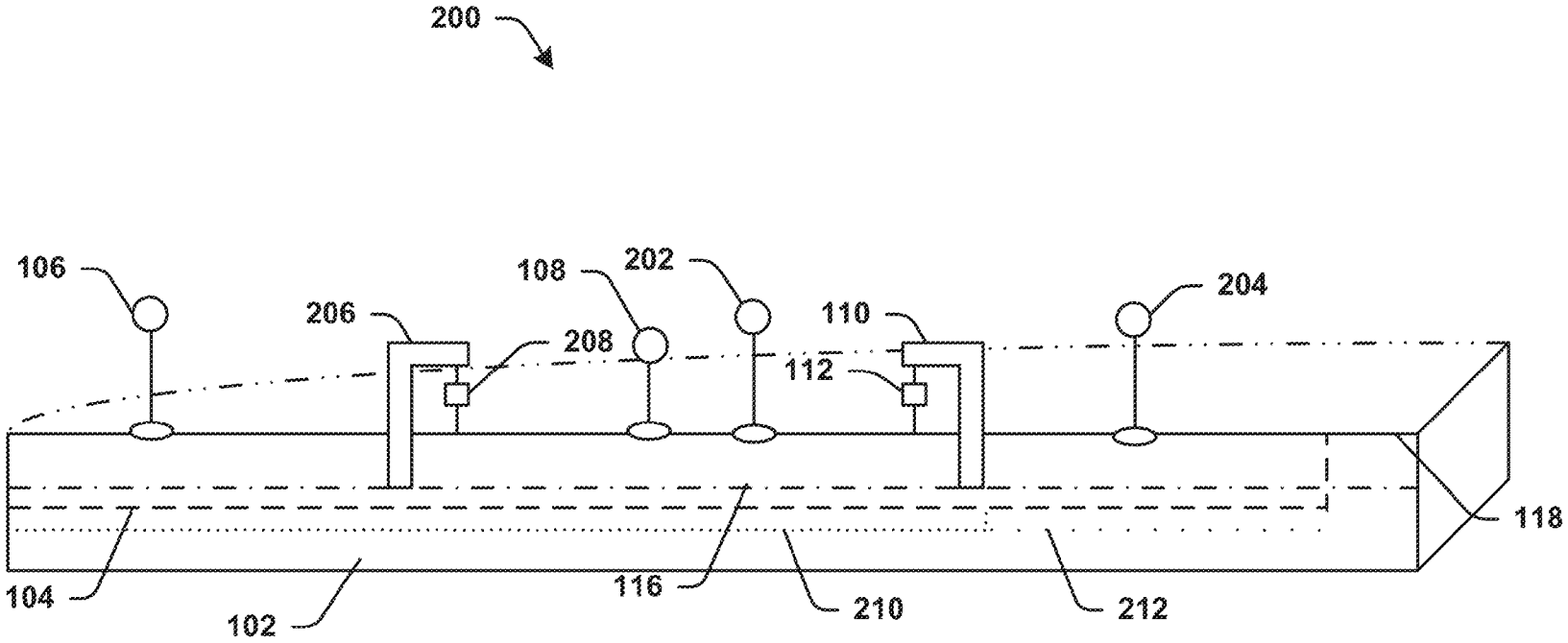
FIG. 2 is another block diagram illustrating a system for an antenna device according to various aspects described.

Referring to FIG. 2, illustrated is a further example of an antenna system in accordance with various aspects. The antenna system 200 includes components or elements as discussed above, and further comprises a third antenna port 202 (as a second WLAN antenna port), a fourth antenna port 204 and a second coupler 206.

The first volume 104 can be further subdivided into two different subsections or subsets of the body 102 so that the first volume comprises a first subset volume 210 and a second subset volume 212 of the body 102. The first subset 210 of the volume 104 and the second subset 212 of the volume 104 can be two different volumes located adjacent and proximate to one another, such as along the same edge 118 or in a same portion of the body 102, which can be a subset of a volume that is less than an entire volume of the device.

Components within the first subset 210 of volume 104 and the second subset 212 of volume 104 can operate in conjunction within one another to facilitate communications within different ranges of frequencies without having parasitic coupling effects that deter communications over the antenna port 106, the antenna port 108, the third antenna port 202 and the fourth antenna port 204 at the same time, concurrently, or simultaneously, for example.

In one embodiment, the coupler 206 can be a second coupler that operates to indirectly couple both the first WLAN antenna port (second antenna port) 108 and the second WLAN antenna port (third antenna port) 202. This can be facilitated by providing a single coupler element 206 that can operate to match an impedance of a first WLAN antenna element (e.g., corresponding to a WLAN frequency of about 5150 MHz to 5850 MHz) at the first WLAN antenna port 108 and a second WLAN antenna element (e.g., corresponding to a second WLAN frequency range of about 2400 MHz to about 2484 MHz) of the second WLAN antenna port 202. The first and second couplers 110 and 206 can thus operate to indirectly and electromagnetically (capacitively or inductively) couple communications from a communication component with respective antenna ports 106, 108, and 202, for example, within a same volume 104 of the body 102.

In other embodiments, the second coupler 206, as a single component, can operate as a WLAN antenna element while also providing an indirect coupling to one of the first WLAN antenna port 108 or the second antenna port 202. For example, the second coupler 206 can operate as a second WLAN antenna element that resonates in a higher WLAN frequency range than a WLAN antenna element of the second WLAN antenna port 202, in which case the first antenna port 108 would not necessarily be provided in the volume 104 of the body 102. As such, the second coupler 206 and the second antenna port 202 could then operate for communications in both WLAN frequency ranges of 2400 MHz to about 2484 MHz and about 5150 MHz to 5850 MHz, without the first antenna port 108.

The feed elements 112 and 208 can be in electrical communication with one or more communication components (e.g., an antenna element, a transceiver, a receiver, transmitter or the like) and generally extend from the body 102 to a corresponding coupler 110 or 206, which is further detailed in FIG. 3. The feed elements 112 and 208 can be formed from any suitable conductive element. In particular, a direct connection is not provided between the feed elements 112 and 208 and the antenna ports 106, 108 and 202 when signals are transmitted or received thereat. Rather, the feed elements 112 and 208 are configured to receive one or more signals from a transceiver or other communication component and provide signals received to the couplers 110 and 206 respectively, which forms an indirect inductive or capacitive coupling with the corresponding antenna ports 106, 108 and 202, respectively.

For example, the indirect couplers 110 and 206 are electromagnetically coupled to the antenna ports 106, 108 and 202, respectively, or antenna components thereat. This enables the energy transmitted to the couplers 110 and 206 to be provided indirectly to the antenna ports 106, 108, and 208, respectively, which can then resonate or communicate signals according to one or more antenna components and corresponding frequency ranges. The performance of the communication system 200 can thus be affected by a capacitive or inductive coupling, for example, between the ground plane 116 and both the couplers 110, 206 and antenna components at the antenna ports 106, 108 and 202, respectively. The couplers 110 and 206 therefore enable an indirect (electromagnetic) coupling of signals being communicated to or from the antenna ports 106, 108 and 202 for transmitting and receiving communications at one or more resonant frequencies or frequency ranges.

The fourth antenna port 204 can be located in the second subset 212 of the first volume 104 of the body 102. The antenna port 204 can be a fourth high band antenna port 204 that is configured to operate at a resonant frequency range that is greater than the low band frequency range of the first antenna port 106. For example, the frequency range associated with the fourth antenna port 204 can be from about 1300 MHz to about 3800 MHz in order to accommodate a high band frequency range of about 1428 MHz to 1511 MHz (e.g., for LTE bands 11 and 12), about 1710 MHz to 2690 MHz, about 3400 MHz to 3800 MHz, or about 1710 MHz to 3800 MHz, and also along with a mid-level frequency range of about 1300 MHz to 1710 MHz, for example. In one aspect, the second subset volume 212 and the components thereat, such as the antenna port 204 can operate within a resonant frequency range that includes the high level resonant frequency range and the mid-level resonant frequency range from about 1300 MHz to 3800 MHz, for example.

Referring to FIG. 3, illustrated is another example embodiment of an antenna system for communicating one or more signals with different antennas of differing networks and in different frequency ranges via couplers among adjacent volumes of a communication device in accordance with the various aspects being described. The antenna system comprises similar components as discussed above, and further includes a low band antenna 302, a first WLAN antenna 304, a second WLAN antenna 306, a high band antenna 308, and a feed component 310.

The body 102 includes a volume or substrate of a mobile or wireless device that further comprises a communication component 318 (e.g., a transmitter, a receiver, a transceiver, or other communication component). The communication component 318 communicates communication signals and processes them with the antenna elements 302, 304, 306, and 308 via the different couplers 110, 206 indirectly or by a direct connection, such as to the antenna 308. As such, the communication component 318, for example, can be directly coupled or indirectly coupled to the different antennas located in the first volume 104 via one or more couplers, in which different configurations can be envisioned in addition or alternatively to the architecture of FIG. 3. In further examples discussed below, a direct coupling can be defined as a direct connection between the communication component (e.g., receiver, transmitter, transceiver or the like) and a given antenna port or the antenna element coupled thereto.

The first WLAN antenna 304 can operate to resonate in a first WLAN frequency range, such as from about 5150 MHz to 5850 MHz, for example, while the second WLAN antenna 306 can operate to resonant in a second WLAN frequency ranges, such as from about 2400 MHz to about 2484 MHz for example, or vice versa. Although FIG. 3 illustrates one example of the WLAN antenna system 330 with the coupler 206, and the first and second WLAN antennas 304 and 306, other architectures can also be envisioned according to one of ordinary skill in the art. For example, the coupler 206, and antennas 304, 306 of the WLAN antenna system 330 are not limited to any one location within the first volume 104 or within the first subset 210 of the volume 104. The coupler and antennas 304, 306 can be located closer to the first antenna port 106 of the low band antenna 302, for example, or father away from the first antenna port 106 toward the indirect coupler 110, for example. Furthermore, the WLAN antenna system could be reduced to the coupler 206 and the second WLAN antenna 306, in which the coupler 206 could further operate to resonate as an antenna element in a frequency range of about 5150 MHz to 5850 MHz, and the second WLAN antenna 306 could cover the frequency range of about 2400 MHz to about 2484 MHz, without the first WLAN antenna 304 being present. The WLAN antenna system 330 therefore operates in various configurations to cover an entire wireless frequency range in the same subset 210 of volume 104 as the low band antenna 302.

In one example of FIG. 3, the low band antenna 302 can be indirectly coupled to the communication component 318 via a conduction path 322 and the coupler 110. The first WLAN antenna 304 and the second WLAN antenna 306 can be indirectly coupled to the communication component 318 via the conduction path 320 and the coupler 206. In addition, the fourth antenna 308 can be a high band antenna that resonates or operates in a high band resonant frequency range, such as about 1300 MHz to 3800 MHz, for example, which can be connected to the communication component via a direct single feed connection via a connection path 322 and a dual feed component 310.

In an embodiment, the dual feed component 310 is configured to improve a matching between the communication component 318 and the low band antenna 302, as well as a matching between the communication component 318 and the high band antenna 308. The low band antenna 302 and the high band antenna 308 can be coupled to the communication component 318 via the dual feed component 310 for transmitting and receiving communications independently or concurrently. For example, the coupler 110 can be electromagnetically (inductively or capacitively) coupled to the low band antenna 302 and directly connected to the dual feed component 310, which is also coupled to the communication component 318 via the conduction path 322.

In addition, the dual feed component 310 is a dual feed element because it feeds signals to two different antennas 302 and 308. Although the dual feed component 310 directly connects the communication component 318 to the high band antenna 308 and indirectly connects signals to the low band antenna 302, the dual feed component could also provide an indirect connection to the high band antenna 308, or a direct connection to the low band antenna 302.

While these embodiments or aspects are illustrated and described as examples other configurations or architectures can also be envisioned as one of ordinary skill in the art could appreciate. For example, the dual feed component 310 could comprise single feed components respectively coupled to the low band antenna 302 or the high band antenna 308 to provide independent and separate matching to each antenna as separate feed elements.

In another embodiment, the low band antenna 302 can be coupled to the ground plane 116 via a parallel resonator component 326, which can include at least one of an inductor, a capacitor, a choking coil, another element or a combination of elements to further force the low band antenna 302 to resonate at a desired frequency within the low band resonating frequency range (e.g., 600 MHz to 960 MHz). The parallel resonator component 326, for example, can comprise an inductor 333 and a capacitor 335 connected in parallel to one another. The value of the inductance in the parallel resonator component 326 can be used to control the resonance frequency of the low band antenna 302, while the value of the capacitor can be utilized to provide the resonance frequency of the parallel resonator component 326 for a desired choking frequency, such as at about 2442 MHz, for example.

The parallel resonator component 326 being connected to the grounding plane 116 can further operate to isolate a different desired frequency of the high band resonant frequency range (e.g., about 1300 MHz to 3800 MHz) associated with the high band antenna 308 from the second WLAN resonant frequency range (e.g., 2400 MHz to about 2484 MHz). Thus, by making the parallel resonator component 326 to ground the high band antenna 308 can be isolated from the WLAN frequency range of within 2400 MHz to about 2484 MHz, which can function with less interference occurring between the second WLAN antenna and the high band antenna 308 within this frequency range.

In another embodiment, the low band antenna 302 can also be coupled to ground 116 directly in response to a desired frequency being achieved in resonance by the low band antenna 302, in which case the low band antenna 302 could further be extended to the ground plane 116, for example. Further, a choke or isolation component (further detailed infra in FIG. 6) could also be implemented within the volume 104 to replace the parallel resonator component 326 to isolate the low band antenna within a desired frequency range from the high band antenna 308, for example.

In another aspect, the high band antenna 308, as a fourth antenna in the volume 104, can comprise a monopole resonating element 312, a parasitic resonating element 316, and a coupling element 314. The antenna system 300 with the high band antenna 308 can utilize a form factor or design parameter of a communication device, such as a tablet or a laptop, where the distance along the edge of the body 102 (e.g., a chassis) is less critical than the distance from the edge of the chassis and increases the antenna volume 104 by adding the parasitic resonating element 316. However, the volume 104 (having low band and high band antennas) for the communication system is not increased, and the WLAN frequencies of the high band frequencies is shared within the same volume 104 with other antennas, such as a low band antenna. This parasitic resonating element 316 can be a low Q parasitic element that operates in a unique way to increase the impedance bandwidth of the antenna 308 and provide for a wide band of operation. Thus, the high band antenna 308 can be operable to accommodate the APJ bands or a mid-level frequency range (e.g., within about 1300 MHz to 1710 MHz), such as, for example, Japanese frequency bands of APJ within about 1438 MHz to 1511 MHz, or a global navigation satellite system (GNSS) bandwidth for an antenna (e.g., about 1476 MHz to 1605 MHz). A particular advantage of the system 300 is that the antenna system 300 can operate to cover a wide bandwidth from about 600 MHz to about 3800 MHz with the APJ or GNSS bands being covered by the high band antenna 308 at the same time, and further can include upcoming bands 42 and 43 (e.g., about 3400 MHz to 3800 MHz).

In another aspect, the parasitic resonating element 316 can be connected directly to a ground or the ground plane 116 when the parasitic resonating element 316 is resonating at a desired frequency. Alternative or additionally, the parasitic resonating element 316 can be connected via an inductor 324, grounding coil or other resonating component coupled to ground 116 in order to force the parasitic resonating element 316 to resonate at a lower frequency than a high band frequency range of about 1710 MHz to 2690 MHz, for example, which enables coverage of the mid-range frequency range, as discussed above.

The coupling element 314 is configured to couple the monopole resonating element 312 and the parasitic resonating element 316. The coupling element 314 can comprise a floating coupling element, for example, in which it can be adjusted based on a desired frequency range for the fourth antenna 308. The coupling element 314 can control the frequency range of the fourth antenna 308 based on the size (e.g., a length) and a relative distance between the coupling element 314 and the two antenna elements (the monopole resonating element 312 and the parasitic resonating element 316), for example. The coupling element 314 is used to control the coupling the two antenna elements 312 and 316 without changing the physical length (or the resonance frequency) of these elements. In other embodiments, the length of overlap between the monopole resonating element 312 and the parasitic resonating element 316 can be varied to provide similar resonant and frequency range effects without the coupler element 314.

Figure 4:
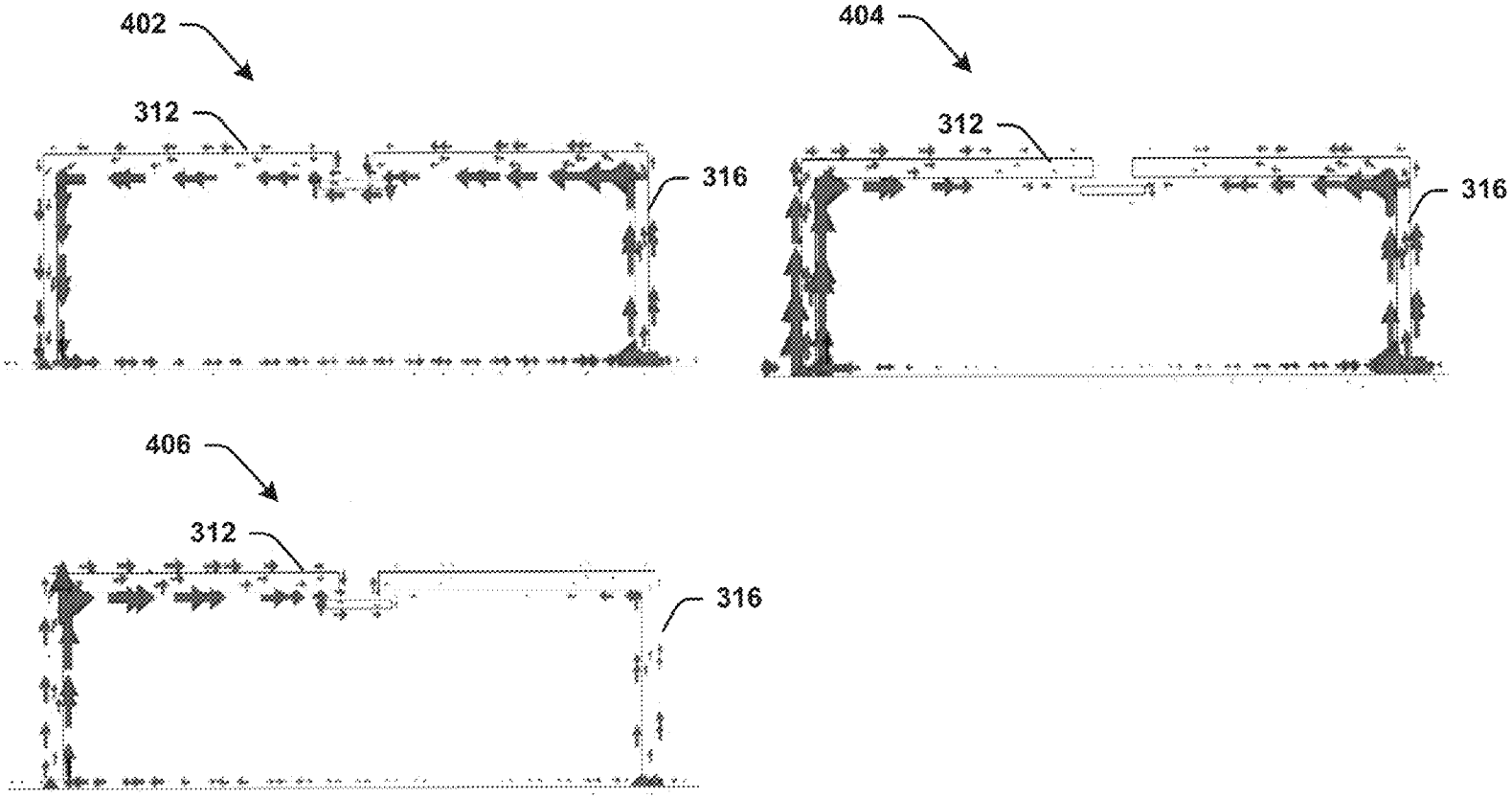
FIG. 4 is diagram of displacement vectors according to various modes of an antenna device according to various aspects described.

Referring to FIG. 4, illustrates different modes of operation related to the fourth antenna element 308 as illustrated in FIG. 3, which can be controlled via different parameters of the high band antenna 308, for example. A loop mode 402, a dipole mode 404, and a monopole mode 406 are demonstrated, for example, by the displacement vectors surrounding the monopole resonating element 312, the coupling element 314, and the parasitic resonating element 316 of the high band antenna 308.

The coupling element 314 can be used to control the coupling between the monopole resonating element 312 and the parasitic resonating element 316 for the different modes. For example, the effect of the parasitic resonating element 316 for the different modes can be controlled based on a length of the overlap between the coupling element 314 and the two resonating elements 312 and 316. The loop mode 402 of the antenna 308 demonstrates operation at about 1300 MHz, which is defined by the length of the electrical flow along the two antenna resonating elements (the monopole resonating element 312 and the parasitic resonating element 316). In another example, the dipole mode 404 demonstrates the antenna 308 operating at 2000 MHz, which is defined by the length of the electrical flow along the two elements 312 and 316 and the inductor 324, or other resonating component, to ground in the parasitic resonating element 316. The monopole mode 406 of the antenna 308 is further illustrated as the antenna resonating at 2700 MHz, which is defined by the electrical length of the monopole resonating element 312.

Figure 5:
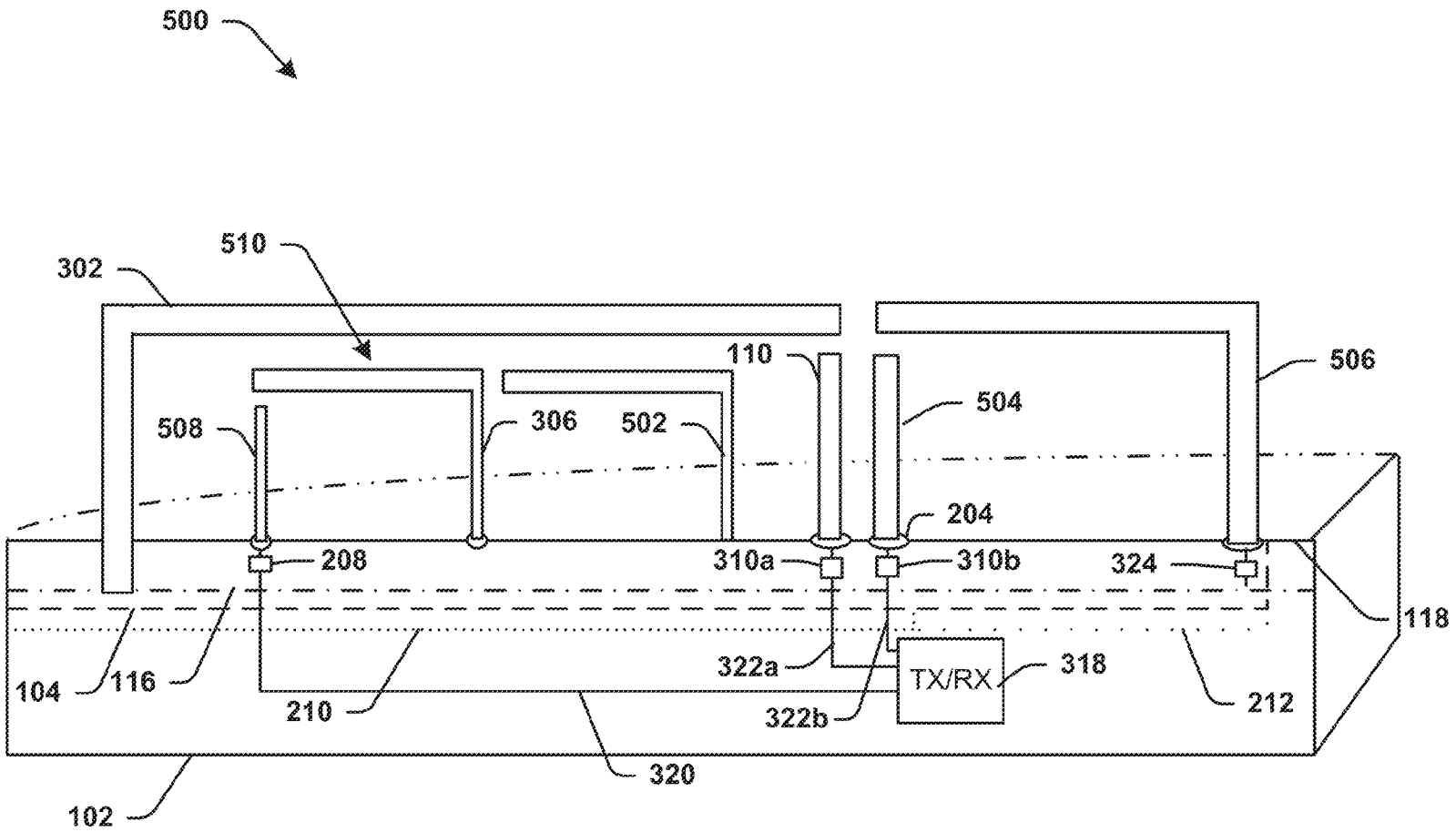
FIG. 5 is another block diagram of an antenna device according to various aspects described.

Referring to FIG. 5, illustrated is another example of an antenna system 500 in accordance with various aspects being described. The antenna system 500 comprises similar components as discussed above, and further comprises an isolation component 502, an indirect coupler 504, a high band antenna 506, an indirect coupler and antenna 508, and a WLAN antenna system 510.

In an additional configuration, the isolation component 502 is configured to provide an additional isolation between the WLAN antenna system 510 and the high band antenna 506. The isolation component 502 can comprise a choke that is located within the first subset 210 of the volume 104. The isolation component 502 operates to further isolate the frequency range of the high band antenna 506 from the WLAN frequency range of the WLAN antenna system 510.

For example, the isolation component 502 can be an additional element that enables the frequency range of the WLAN frequency antenna 306 (e.g., about 2400 MHz to about 2484 MHz) to be isolated from, or to not be affected by interference from, the high band frequency range of about 1300 MHz to 3800 MHz of the high band antenna 506. This particular configuration can be implemented, for example, without use of the parallel resonator component 326, as discussed in FIG. 3. As such, the low band antenna element can resonate at the desired frequency range based on the physical dimensions of the low band antenna, which can be connected to the ground plane 116.

The WLAN antenna system 510 therefore includes the WLAN antenna 306 and the coupler 508. The coupler and antenna 508 operates as a coupler and an additional WLAN antenna element. As a coupler, the coupler 508 is configured to indirectly (electromagnetically) couple the signal feed component 208 and conduction path 320 with signals from the WLAN antenna 306, which operates within a frequency range of about 2400 MHz to 2484 MHz. As an antenna element, the coupler and antenna 508 further operates as an additional WLAN antenna to resonate within a frequency range of about 5200 MHz to 5600 MHz. The coupler and antenna 508 has a direct coupling provided via the feed element 208 to the conduction path 320 and the communication component 318. The WLAN antenna system 510 therefore enables bandwidth coverage within both WLAN frequency ranges with good isolation from the high band antenna 506.

In another aspect, the high band antenna 506 operates as the high band antenna for a frequency range of about 1710 MHz to 3800 MHz via an indirect (electromagnetic) coupling of a high band coupler 504. The high band coupler 504 is connected to the feed component **310*b*, which is connected to the communication component 318 via a connection path 322*b*. The high band antenna 506, for example, can be implemented in this configuration in cases where the LTE bands 11 and 21 are not as essential. In addition, the indirect coupler 110 can be connected to a feed component 310*a* that is separate from the feed component 310*b*. The feed component 310*a* can also be connected to the communication component 318 via a connection path 322*a* that is separate from the connection path 322*b*. This configuration of FIG. 5 having two separate connection paths 322*a* and 322*b* to the communication component 318 for the low band antenna 302 and the high band antenna 506, respectively, can be considered a dual feed configuration, which is different from the configuration of FIG. 3 with a single feed configuration having one connection path 322 from the feed component 310 to the communication component 318 for antennas 302 and 308. In alternative embodiments, the feed component 310*a* and 310*b* can also be a single feed component 310 with separate connections 322*a* and 322*b* to the communication component 318 for the antennas 302 and 506** respectively.

Figure 6:
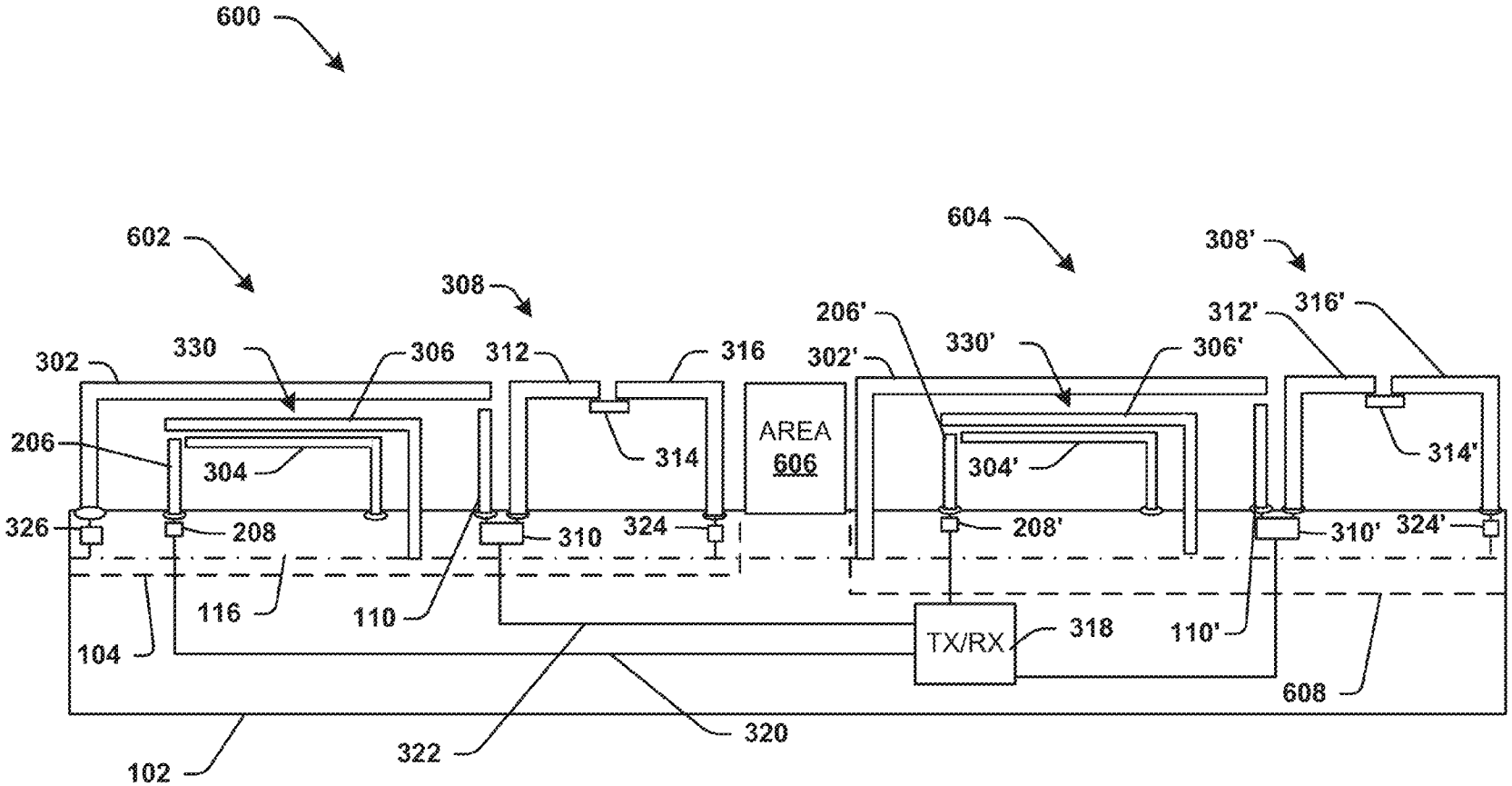
FIG. 6 is a block diagram of an antenna device according to various aspects described.

Referring to FIG. 6, illustrated is another example of an antenna system in accordance with various aspects described herein. The antenna system 600 includes the antenna system 602 and the antenna system 604 within a communication device (e.g., a laptop, a tablet, or other mobile communication device having a processor and a memory).

Although the antenna systems 602 and 604 are illustrated with similar components, elements, aspects, embodiments, and architectures as illustrated above with respect to FIGS. 1-3, for example, the same components, elements aspects, embodiments, and architectures as described above with respect to FIG. 5 can also be embodied in both antenna systems 602 and 604, or one of antenna systems 602 or 604, for example. In one example, antenna systems 602 and 604 can be mirrored versions of each other.

In one embodiment, the antenna system 604 can comprise at least one additional cellular low band antenna 302' configured to transmit or receive the one or more cellular low band signals at a lower cellular frequency range than a frequency range of the at least one high band antenna 308'. At least one additional first coupler 110' is configured to indirectly (electromagnetically) couple to the at least one additional cellular low band antenna 302'. At least one additional WLAN antenna 330' is configured to transmit or receive the one or more WLAN signals. The additional WLAN antenna 330' can include two WLAN antenna 304' and 306'. The at least one additional cellular high band antenna 308' is configured to transmit or receive the one or more cellular high band signals in a high band frequency range and a mid-level range.

The at least one additional cellular high band antenna 308' can comprise a monopole element 312', a coupler element 314' and a parasitic element 316', for example. The antenna 308' can be directly coupled to the dual feed component 310', which is also coupled to the antenna 302' with an indirect coupler 110'. Alternatively, the cellular high band antenna 308' can be indirectly coupled to the dual feed component 310', as illustrated in FIG. 5 with the high band antenna 506, for example. Other variations, embodiments, and aspects described above in FIGS. 1-5 can also apply to the antenna systems 602 or 604, for example. In the present example of FIG. 6, the antenna system 604 comprises similar components as illustrated in the antenna system 602. For ease of explanation, these components will not be re-described.

In one embodiment, the antenna system 600 comprises an area 606 that represents a reserved area that can comprises various components not show that can be reside within a communication devices, such as one or more of cameras, microphones, sensors, processors, circuitry and the like. The area 606 separates the antenna system 602 from the antenna system 604 so that the two systems 602 and 604 are not within the same volume. Rather, the antenna system 602 is within the first volume 104 and the antenna system 604 is located within a second volume 608.

In another embodiment, the first volume 104 can be larger than the second volume 608 in order to cover a wider impedance bandwidth. For example, the first volume 104 can comprise a main antenna volume with dimensions of about 12 mm×98 mm, while the second volume 608 can comprise a diversity volume with dimensions of about 12 mm×89 mm, for example.

The antenna system 600 is particularly well suited for a 2×2 MIMO WiFi system, for example, in which two different WLAN antenna systems covering both WLAN frequency ranges in each WLAN system are utilized. In addition, each antenna system 602 and 604 in volumes 104 and 608 can be specifically designated for a diversity of communications and communication standards. For example, the antenna system 604 can operate to cover both GNSS and APJ frequency range (e.g., about 1559 MHz to 1610 MHz), while the main antenna could cover a different standard or frequency range, such as the APJ bands of Japan or other like bands (e.g., about 1438 MHz to 1511 MHz), for example. Alternatively other designations can also be provided for and associated with the antenna system 602 or 604 respectively, and no one particular standard, frequency range or sub-frequency range is limited herein.

Figure 7:
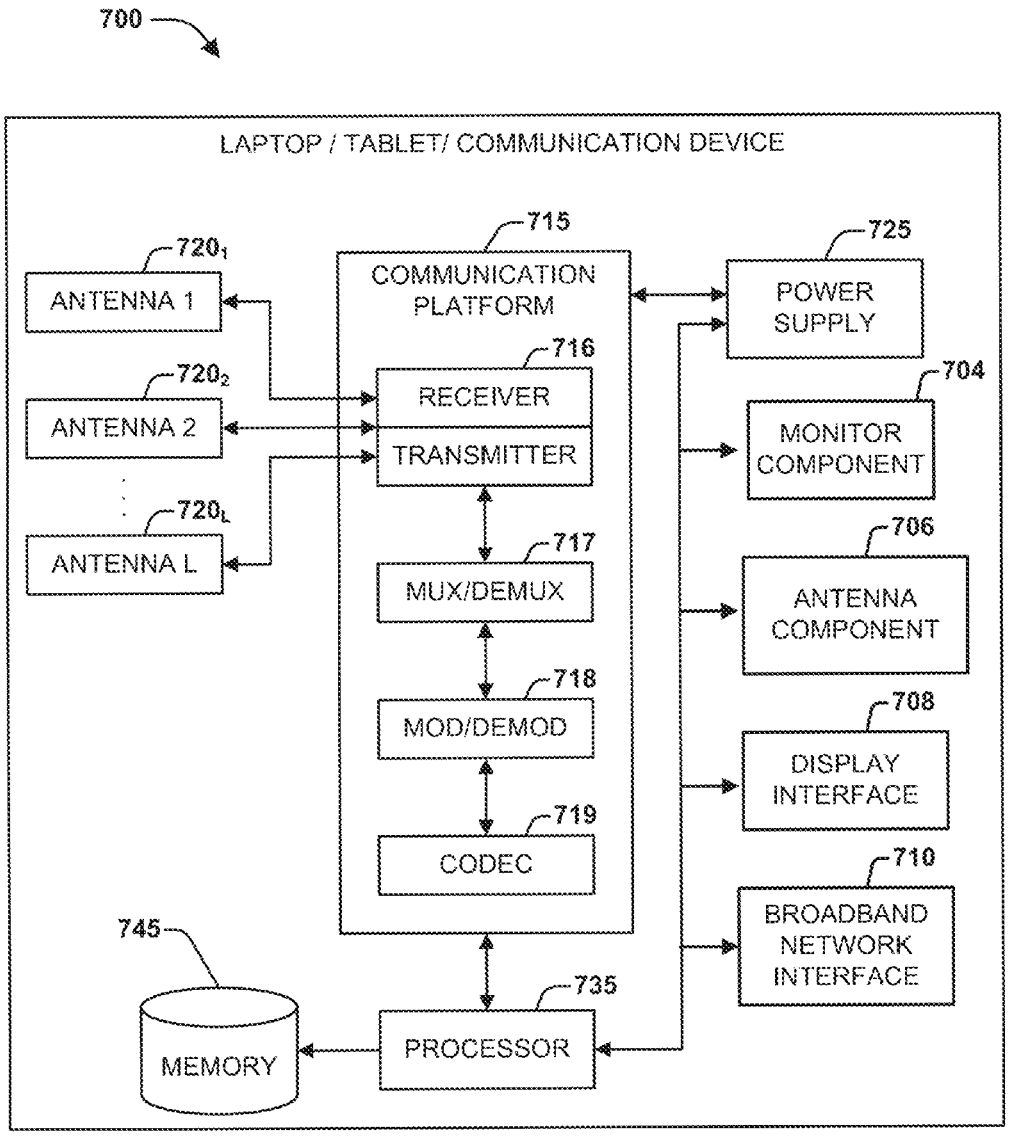
FIG. 7 is an exemplary wireless terminal for utilizing various aspects described.

In order to provide further context for various aspects of the disclosed subject matter, FIG. 7 illustrates a non-limiting example of a computing device, such as a laptop, tablet, or other communication device or wireless terminal 700 that can implement some or all of the aspects described herein. In an aspect, wireless terminal, such as a laptop, tablet, other communication device, or wireless terminal 700 can receive and transmit signal(s) to and/or from wireless devices such as APs, access terminals, wireless ports and routers, or the like, through a set of L antennas 720, which can be configured according to one or more embodiments or aspects described herein. In one example, antennas 720 can be implemented as part of a communication platform 715, which in turn can comprise electronic components and associated circuitry and/or other means that provide for processing and manipulation of received signal(s) and signal (s) to be transmitted. The antennas 720 can comprise the various antenna elements incorporating the different aspects or embodiments disclosed herein. In one example, the antennas 720 can be located along an edge or side 720 of the wireless terminal 700, which can be within a same quadrant, section, portion or subset of the volume of the mobile device.

In an aspect, communication platform 715 can include a monitor component 704 and antenna component 706, which can couple to communication platform 715 and include electronic components with associated circuitry that provide for processing and manipulation of received signal(s) and other signal(s) to be transmitted. The communication platform 715 can further comprise a receiver/transmitter or transceiver 716, which can transmit and receive signals and/or perform one or more processing operations on such signals (e.g., conversion from analog to digital upon reception, conversion from digital to analog upon transmission, etc.). In addition, transceiver 716 can divide a single data stream into multiple, parallel data streams, or perform the reciprocal operation.

Additionally, the communication device 700 can include display interface 708, which can display functions that control functionality of the device 700, or reveal operation conditions thereof. In addition, display interface 708 can include a screen to convey information to an end user. In an aspect, display interface 708 can be a liquid crystal display, a plasma panel, a monolithic thin-film based electro chromic display, and so on. Moreover, display interface 708 can include a component (e.g., speaker) that facilitates communication of aural indicia, which can also be employed in connection with messages that convey operational instructions to an end user. Display interface 708 can also facilitate data entry (e.g., through a linked keypad or through touch gestures), which can cause access equipment and/or software 700 to receive external commands (e.g., restart operation).

Broadband network interface 720 facilitates connection of access equipment and/or software 700 to a service provider network (not shown) that can include one or more cellular technologies (e.g., third generation partnership project universal mobile telecommunication system, global system for mobile communication, and so on) through backhaul link(s) (not shown), which enable incoming and outgoing data flow. Broadband network interface 710 can be internal or external to access equipment and/or software 700, and can utilize display interface 708 for end-user interaction and status information delivery.

Processor 735 can be functionally connected to communication platform 708 and can facilitate operations on data (e.g., symbols, bits, or chips) for multiplexing/demultiplexing, such as effecting direct and inverse fast Fourier transforms, selection of modulation rates, selection of data packet formats, inter-packet times, and so on. Moreover, processor 735 can be functionally connected, through data, system, or an address bus, to display interface 708 and broadband network interface 710, to confer, at least in part, functionality to each of such components.

In another example, a multiplexer/demultiplexer (mux/demux) unit 717 can be coupled to transceiver 716. Mux/demux unit 717 can, for example, facilitate manipulation of signal in time and frequency space. Additionally or alternatively, mux/demux unit 717 can multiplex information (e.g., data/traffic, control/signaling, etc.) according to various multiplexing schemes such as time division multiplexing (TDM), frequency division multiplexing (FDM), orthogonal frequency division multiplexing (OFDM), code division multiplexing (CDM), space division multiplexing (SDM), or the like. In addition, mux/demux unit 717 can scramble and spread information according to substantially any code generally known in the art, such as Hadamard-Walsh codes, Baker codes, Kasami codes, polyphase codes, and so on.

In a further example, a modulator/demodulator (mod/demod) unit 718 implemented within communication platform 715 can modulate information according to multiple modulation techniques, such as frequency modulation, amplitude modulation (e.g., L-ary quadrature amplitude modulation (L-QAM), etc.), phase-shift keying (PSK), and the like. Further, communication platform 715 can also include a coder/decoder (codec) module 719 that facilitates decoding received signal(s) and/or coding signal(s) to convey.

According to another aspect, wireless terminal 700 can include a processor 735 configured to confer functionality, at least in part, to substantially any electronic component utilized by wireless terminal 700. As further shown in system 700, a power supply 725 can attach to a power grid and include one or more transformers to achieve a power level at which various components and/or circuitry associated with wireless terminal 700 can operate. In one example, power supply 725 can include a rechargeable power mechanism to facilitate continued operation of wireless terminal 700 in the event that wireless terminal 700 is disconnected from the power grid, the power grid is not operating, etc. The high band antenna 308 or 506, for example, with the other antenna element configurations disclosed herein can further facilitate communications with a wireless charging of the power supply 725, such as with a transfer of energy from the antenna system to the power supply 725 via an oscillating magnetic field, for example.

In a further aspect, processor 735 can be functionally connected to communication platform 715 and can facilitate various operations on data (e.g., symbols, bits, chips, etc.), which can include, but are not limited to, effecting direct and inverse fast Fourier transforms, selection of modulation rates, selection of data packet formats, inter-packet times, etc. In another example, processor 735 can be functionally connected, via a data or system bus (e.g., a wireless PCIE or the like), to any other components or circuitry not shown in system 700 to at least partially confer functionality to each of such components, such as by the antenna systems disclosed herein.

As additionally illustrated, a memory 745 can be used by wireless terminal 700 to store data structures, code instructions and program modules, system or device information, code sequences for scrambling, spreading and pilot transmission, location intelligence storage, determined delay offset(s), over-the-air propagation models, and so on. Processor 735 can be coupled to the memory 745 in order to store and retrieve information necessary to operate and/or confer functionality to communication platform 715 and/or any other components of wireless terminal 700.

Further, the antenna systems described above with the communication device 700 can also be configured, for example, to operate at a wide range of frequencies in a high band frequency range additionally include peer-to-peer (e.g., mobile-to-mobile) ad hoc network systems often using unpaired unlicensed spectrums, 802.xx wireless LAN, BLUETOOTH and any other short- or long-range, wireless frequency ranges and communication techniques. The high band antenna elements disclosed herein, such as high band antennas 308 or 506, for example, can also be configured to operate at other high band frequency ranges also. For example, a micro wave or a millimeter wave frequency range could also be an operational frequency range of the high band antennas 308 or 506, such as in the range of about 30 GHz to 300 GHz, for example. The high band antenna elements 308 or 506, for example can be operational for 2GPP, 3GPP, 4GPP, 5GPP or combination of communication standards.

In other examples, the high band antenna elements 308 or 506 can operate to communicate wirelessly with other components, such as the display interface 708 as a wireless device, or with other wireless interfaces, such as a wireless USB device, for example. For example, a wireless USB device can communicate within a 3.1 to a 10.6 GHz frequency range. In addition, the antenna systems disclosed can be configured to communicate with other wireless connections, components, interfaces or devices in order to provide communication interfacing for wireless component-to-component communications. For example, a PCB to PCB interface can be facilitated by the high band antenna systems as well as micro millimeter wave communications among one or more internal or external components. Other communication interfaces can also be facilitated by the antenna elements disclosed such as an internet of things (IoT) to IoT components, wearable components, mobile to mobile, a network base station (e.g., a macro cell network device, femto cell device, pico cell device or other network devices) or any combination thereof to communicate via one of more of the antenna elements, such as via the antenna system 602 or 604, for example. Additional other examples are also envisioned by which the antenna systems disclosed herein can operate in different frequency ranges, as well as communication and facilitate communications with, or among, one or more wireless components or devices. For example, industrial, scientific and medical (ISM) radio bands, radar band widths, or other ranges of a frequency spectrum can also be facilitated for communications by the antenna systems being disclosed.

Examples may include subject matter such as a method, means for performing acts or blocks of the method, at least one machine-readable medium including instructions that, when performed by a machine cause the machine to perform acts of the method or of an apparatus or system for concurrent communication using multiple communication technologies according to embodiments and examples described herein.

Example 1 is a device for communicating one or more communication signals comprising a first antenna port, located in a first antenna volume of a body, configured to operate at a first resonant frequency range; a first coupler configured to indirectly couple the first antenna port with a first feed signal component to transmit or receive the one or more communication signals at the first resonant frequency range; and a second antenna port, located in the first antenna volume of the body, configured to operate at a second resonant frequency range that is different than the first resonant frequency range.

Example 2 includes the subject matter of Example 1, further comprising: a third antenna port, located in the first antenna volume of the body, configured to operate at a third resonant frequency range that is different than the first resonant frequency range and the second resonant frequency range; and a second coupler configured to indirectly couple at least one of the second antenna port or the third antenna port with a second feed signal component to transmit or receive the one or more communication signals in at least one of the second resonant frequency range or the third resonant frequency range, respectively.

Example 3 includes the subject matter of any of Examples 1 and 2, including or omitting optional elements, wherein the second coupler is further configured to selectively couple the second feed signal component among the second antenna port and the third antenna port to transmit or receive the one or more communication signals in at least one of the second resonant frequency range or the third resonant frequency range.

Example 4 includes the subject matter of any of Examples 1-3, including or omitting optional elements, further comprising: a fourth antenna port, located in a second antenna volume of the body and adjacent to the first antenna volume, configured to operate at a fourth resonant frequency range that is greater than the first resonant frequency range.

Example 5 includes the subject matter of any of Examples 1-4, including or omitting optional elements, wherein the first resonant frequency range comprises about 699 MHz to 960 MHz, the second resonant frequency range comprises about 2400 MHz to 2484 MHz, the third resonant frequency range comprises about 5150 MHz to 5850 MHz, and the fourth resonant frequency range comprises about 1300 MHz to 3800 MHz.

Example 6 includes the subject matter of any of Examples 1-5, including or omitting optional elements, wherein the first antenna port is further configured to connect to a cellular low band antenna, the second antenna port is further configured to connect to a first WLAN antenna, the third antenna port is configured to connect to a second WLAN antenna, and the fourth antenna port is configured to connect to a cellular high band antenna.

Example 7 includes the subject matter of any of Examples 1-6, including or omitting optional elements, further comprising: a third antenna port, located within the first antenna volume of the body, configured to couple the one or more communication signals with a WLAN antenna configured to transmit or receive the one or more communication signals by operating in a WLAN frequency range; wherein the second antenna port is further configured to couple the one or more communication signals with another WLAN antenna configured to transmit or receive the one or more communication signals by operating in another WLAN frequency range that is different than the WLAN frequency range.

Example 8 includes the subject matter of any of Examples 1-7, including or omitting optional elements, further comprising: a fourth antenna port, located in a second antenna volume of the body and adjacent to the first antenna volume, configured to operate at a fourth resonant frequency range that is greater than the first resonant frequency range.

Example 9 includes the subject matter of any of Examples 1-8, including or omitting optional elements, wherein the fourth antenna port is further configured to couple the one or more communication signals with a cellular high band antenna comprising: a monopole resonating element; a parasitic resonating element; and a coupler element configured to couple the monopole resonating element and the parasitic resonating element and control an operational frequency range of the high band antenna component within the fourth resonant frequency range.

Example 10 includes the subject matter of any of Examples 1-9, including or omitting optional elements, further comprising: a parallel resonator comprising an inductor and a capacitor, coupled to the first antenna port and a ground plane of the first antenna volume, configured to facilitate a first antenna element coupled to the first antenna port to selectively resonate at a desired frequency within the first resonant frequency range and isolate a different desired frequency of the fourth resonant frequency range associated with the fourth antenna port from the second resonant frequency range comprising a WLAN frequency range, or an isolation element, located in the first antenna volume, configured to isolate the different desired frequency of the fourth resonant frequency range associated with the fourth antenna port and the second resonant frequency range.

Example 11 includes the subject matter of any of Examples 1-10, including or omitting optional elements, wherein the first feed signal component comprises a dual coupling element configured to indirectly couple to a low band antenna of the first antenna port via the first coupler and directly couple to a cellular high band antenna of the fourth antenna port, or wherein the first feed signal component comprises the dual coupling element configured to indirectly couple to the low band antenna of the first antenna port via the first coupler and indirectly couple to a cellular high band antenna of the fourth antenna port via the third coupler.

Example 12 includes the subject matter of any of Examples 1-11, including or omitting optional elements, further comprising: a third volume of the body configured for an antenna diversity process comprising: at least one additional first antenna port configured to operate at the first resonant frequency range of a low cellular frequency range; at least one additional first coupler configured to indirectly couple the at least one additional first antenna port with an additional first feed signal component to transmit or receive the one or more communication signals at the first resonant frequency range; at least one additional second antenna port configured to operate at second resonant frequency ranges of a WLAN frequency range; and at least one additional fourth antenna port configured to operate at a fourth frequency range of a high cellular frequency range and a mid-level frequency range that is directly coupled, or indirectly coupled, to the additional first feed signal component.

Example 13 is a system for transmitting or receiving one or more communication signals comprising: a first antenna element coupled to a first antenna port, located in a first antenna volume of a body, configured to operate at a first resonant frequency range; a first coupler configured to electromagnetically couple the first antenna element with a first feed signal component to transmit or receive the one or more communication signals at the first resonant frequency range; and a second antenna element coupled to a second antenna port, located in the first antenna volume of the body, configured to operate at a second resonant frequency range that is different than the first resonant frequency range.

Example 14 includes the subject matter of Example 13, including or omitting optional elements, further comprising: a third antenna element coupled to a third antenna port, located in the first antenna volume of the body and adjacent to the second antenna element, configured to operate at a third resonant frequency range that is different than the first resonant frequency range and the second resonant frequency range; and a second coupler configured to electromagnetically couple the second antenna element and the third antenna element with a second feed signal component to transmit or receive the one or more communication signals at the second resonant frequency range or the third resonant frequency range.

Example 15 includes the subject matter of any of Examples 13-14, including or omitting optional elements, wherein the first coupler comprises a cellular low band coupler configured to resonate the first antenna element at a cellular low band antenna resonance of the first resonant frequency range that is lower than the second resonant frequency range and the third resonant frequency range.

Example 16 includes the subject matter of any of Examples 13-15, including or omitting optional elements, further comprising: a parallel resonator comprising a discrete inductor and a capacitor, coupled to the first antenna element and a ground plane of the first antenna volume, configured to facilitate the first antenna element to resonate at a desired frequency within the first resonant frequency range and isolate a different desired frequency of a fourth resonant frequency range associated with a fourth antenna element from the second resonant frequency range, or an isolation element, located within the first antenna volume of the body, configured to isolate operational frequencies of the second antenna element from operational frequencies of the fourth antenna element.

Example 17 includes the subject matter of any of Examples 13-16, including or omitting optional elements, further comprising: a cellular high band antenna element as a fourth antenna element comprising: a monopole resonating element; a parasitic resonating element; and a coupler element configured to couple the monopole resonating element and the parasitic resonating element.

Example 18 includes the subject matter of any of Examples 13-17, including or omitting optional elements, wherein the first coupler is further configured to directly couple the cellular high band antenna element with the first feed signal component to transmit or receive the one or more communication signals at a fourth resonant frequency range comprising about 1400 MHz to 2700 MHz or about 1400 MHz to 3800 MHz.

Example 19 is a communication system comprising: a communication device, configured to transmit or receive one or more wireless communication signals, comprising a first antenna volume of a body comprising: a low band antenna, located within a first subset of the first antenna volume, configured to transmit or receive one or more low band signals; a first coupler configured to electromagnetically couple to the low band antenna to a first feed signal component; a first WLAN antenna, located within the first subset of the first antenna volume, configured to transmit or receive one or more WLAN signals; and a high band antenna configured to transmit or receive one or more high band signals.

Example 20 includes the subject matter of Example 19, including or omitting optional elements, wherein the high band antenna is located adjacent to the low band antenna along an edge of the body in a second subset of the first antenna volume.

Example 21 includes the subject matter of any of Examples 19-20, including or omitting optional elements, further comprising a second antenna volume, separate from and non-adjacent to the first antenna volume of the body, configured to facilitate an antenna diversity communication, comprising: at least one additional low band antenna configured to transmit or receive the one or more low band signals at a lower frequency range than a frequency range of the high band antenna; at least one additional first coupler configured to electromagnetically couple to the at least one additional low band antenna; at least one additional WLAN antenna configured to configured to transmit or receive the one or more WLAN signals; and at least one additional high band antenna configured to transmit or receive the one or more high band signals.

Example 22 includes the subject matter of any of Examples 19-21, including or omitting optional elements, wherein the high band antenna is further configured to operate in a wider high frequency range than the at least one additional high band antenna that includes the one or more high band signals and a mid-level frequency range in a resonant frequency range.

Example 23 includes the subject matter of any of Examples 19-22, including or omitting optional elements, wherein the high band antenna comprises: a monopole resonating element; a parasitic resonating element; and a coupler element configured to couple the monopole resonating element and the parasitic resonating element to control an operational frequency range of the cellular high band antenna based on a relative distance between the monopole resonating element and the parasitic resonating element.

Example 24 includes the subject matter of any of Examples 19-23, including or omitting optional elements, further comprising: a parallel resonator comprising a discrete inductor and a capacitor, located within the first subset of the first antenna volume, coupled to the low band antenna and a ground plane of the first antenna volume, configured to facilitate the low band antenna to resonate at a desired frequency within a low band frequency range and isolate a high band frequency range of the high band antenna from a WLAN frequency range of the first WLAN antenna; or an isolation element, located within the first subset of the first antenna volume, configured to isolate the high band frequency range of the high band antenna from the WLAN frequency range of the first WLAN antenna.

Example 25 includes the subject matter of any of Examples 19-23, including or omitting optional elements, wherein the first feed signal component comprises a dual coupling element configured to indirectly, or directly, couple the low band antenna to a communication component via the first coupler, and, directly or indirectly, couple the high band antenna to the communication component.

Applications (e.g., program modules) can include routines, programs, components, data structures, etc., that perform particular tasks or implement particular abstract data types. Moreover, those skilled in the art will appreciate that the operations disclosed can be practiced with other system configurations, including single-processor or multiprocessor systems, minicomputers, mainframe computers, as well as personal computers, hand-held computing devices, microprocessor-based or programmable consumer electronics, and the like, each of which can be operatively coupled to one or more associated mobile or personal computing devices.

A computing device can typically include a variety of computer-readable media. Computer readable media can be any available media that can be accessed by the computer and includes both volatile and non-volatile media, removable and non-removable media. By way of example and not limitation, computer-readable media can comprise computer storage media and communication media. Computer storage media includes both volatile and non-volatile, removable and non-removable media implemented in any method or technology for storage of information such as computer-readable instructions, data structures, program modules or other data. Computer storage media (e.g., one or more data stores) can include, but is not limited to, RAM, ROM, EEPROM, flash memory or other memory technology, CD ROM, digital versatile disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

It is to be understood that aspects described herein may be implemented by hardware, software, firmware, or any combination thereof. When implemented in software, functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if software is transmitted from a website, server, or other remote source using a coaxial cable, fiber optic cable, twisted pair, digital subscriber line (DSL), or wireless technologies such as infrared, radio, and microwave, then coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

Various illustrative logics, logical blocks, modules, and circuits described in connection with aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform functions described herein. A general-purpose processor may be a microprocessor, but, in the alternative, processor may be any conventional processor, controller, microcontroller, or state machine. A processor may also be implemented as a combination of computing devices, for example, a combination of a DSP and a microprocessor, a plurality of microprocessors, one or more microprocessors in conjunction with a DSP core, or any other such configuration. Additionally, at least one processor may comprise one or more modules operable to perform one or more of the acts and/or actions described herein.

For a software implementation, techniques described herein may be implemented with modules (e.g., procedures, functions, and so on) that perform functions described herein. Software codes may be stored in memory units and executed by processors. Memory unit may be implemented within processor or external to processor, in which case memory unit can be communicatively coupled to processor through various means as is known in the art. Further, at least one processor may include one or more modules operable to perform functions described herein.

Techniques described herein may be used for various wireless communication systems such as CDMA, TDMA, FDMA, OFDMA, SC-FDMA and other systems. The terms "system" and "network" are often used interchangeably. A CDMA system may implement a radio technology such as Universal Terrestrial Radio Access (UTRA), CDMA2000, etc. UTRA includes Wideband-CDMA (W-CDMA) and other variants of CDMA. Further, CDMA2000 covers IS-2000, IS-95 and IS-856 standards. A TDMA system may implement a radio technology such as Global System for Mobile Communications (GSM). An OFDMA system may implement a radio technology such as Evolved UTRA (E-UTRA), Ultra Mobile Broadband (UMB), IEEE 802.11 (Wi-Fi), IEEE 802.16 (WiMAX), IEEE 802.20, Flash-OFDM, etc. UTRA and E-UTRA are part of Universal Mobile Telecommunication System (UMTS). 3GPP Long Term Evolution (LTE) is a release of UMTS that uses E-UTRA, which employs OFDMA on downlink and SC-FDMA on uplink. UTRA, E-UTRA, UMTS, LTE and GSM are described in documents from an organization named "3rd Generation Partnership Project" (3GPP). Additionally, CDMA2000 and UMB are described in documents from an organization named "3rd Generation Partnership Project 2" (3GPP2). Further, such wireless communication systems may additionally include peer-to-peer (e.g., mobile-to-mobile) ad hoc network systems often using unpaired unlicensed spectrums, 802.xx wireless LAN, BLUETOOTH and any other short- or long-range, wireless communication techniques, such as millimeter wave bands in the range of 30 GHz to 300 GHz, for example.

Single carrier frequency division multiple access (SC-FDMA), which utilizes single carrier modulation and frequency domain equalization is a technique that can be utilized with the disclosed aspects. SC-FDMA has similar performance and essentially a similar overall complexity as those of OFDMA system. SC-FDMA signal has lower peak-to-average power ratio (PAPR) because of its inherent single carrier structure. SC-FDMA can be utilized in uplink communications where lower PAPR can benefit a mobile terminal in terms of transmit power efficiency.

Moreover, various aspects or features described herein may be implemented as a method, apparatus, or article of manufacture using standard programming and/or engineering techniques. The term "article of manufacture" as used herein is intended to encompass a computer program accessible from any computer-readable device, carrier, or media. For example, computer-readable media can include but are not limited to magnetic storage devices (e.g., hard disk, floppy disk, magnetic strips, etc.), optical discs (e.g., compact disc (CD), digital versatile disc (DVD), etc.), smart cards, and flash memory devices (e.g., EPROM, card, stick, key drive, etc.). Additionally, various storage media described herein can represent one or more devices and/or other machine-readable media for storing information. The term "machine-readable medium" can include, without being limited to, wireless channels and various other media capable of storing, containing, and/or carrying instruction(s) and/or data. Additionally, a computer program product may include a computer readable medium having one or more instructions or codes operable to cause a computer to perform functions described herein.

Further, the acts and/or actions of a method or algorithm described in connection with aspects disclosed herein may be embodied directly in hardware, in a software module executed by a processor, or a combination thereof. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to processor, such that processor can read information from, and write information to, storage medium. In the alternative, storage medium may be integral to processor. Further, in some aspects, processor and storage medium may reside in an ASIC. Additionally, ASIC may reside in a user terminal. In the alternative, processor and storage medium may reside as discrete components in a user terminal. Additionally, in some aspects, the acts and/or actions of a method or algorithm may reside as one or any combination or set of codes and/or instructions on a machine-readable medium and/or computer readable medium, which may be incorporated into a computer program product.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

In particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention. In addition, while a particular feature may have been disclosed with respect to only one of several implementations, such feature may be combined with one or more other features of the other implementations as may be desired and advantageous for any given or particular application.

What is claimed is:

1. A device for communicating one or more communication signals comprising:

a first antenna port, located in a first antenna volume of a body, configured to operate at a first resonant frequency range;

a first coupler configured to indirectly couple the first antenna port with a first feed signal component to transmit or receive the one or more communication signals at the first resonant frequency range;

a second antenna port, located in the first antenna volume of the body, configured to operate at a second resonant frequency range that is different than the first resonant frequency range;

a third antenna port, located in the first antenna volume of the body, configured to operate at a third resonant frequency range that is different than the first resonant frequency range and the second resonant frequency range; and a second coupler configured to selectively and indirectly couple at least one of the second antenna port or the third antenna port with a second feed signal component to transmit or receive the one or more communication signals in at least one of the second resonant frequency range or the third resonant frequency range, respectively.

2. The device of claim 1, further comprising:

a fourth antenna port, located in a second antenna volume of the body and adjacent to the first antenna volume, configured to operate at a fourth resonant frequency range that is greater than the first resonant frequency range.

3. The device of claim 2, wherein the first resonant frequency range comprises about 699MHz to 960 MHz, the second resonant frequency range comprises about 2400 MHz to 2484 MHz, the third resonant frequency range comprises about 5150 MHz to 5850 MHz, and the fourth resonant frequency range comprises about 1300 MHz to 3800 MHz.

4. The device of claim 2, wherein the first antenna port is further configured to connect to a cellular low band antenna, the second antenna port is further configured to connect to a first WLAN antenna, the third antenna port is configured to connect to a second WLAN antenna, and the fourth antenna port is configured to connect to a cellular high band antenna.

5. The device of claim 1, wherein the third antenna port is further configured to couple the one or more communication signals with a WLAN antenna configured to transmit or receive the one or more communication signals by operating in a WLAN frequency range;

wherein the second antenna port is further configured to couple the one or more communication signals with another WLAN antenna configured to transmit or receive the one or more communication signals by operating in in another WLAN frequency range that is different than the WLAN frequency range.

6. The device of claim 5, further comprising:

a fourth antenna port, located in a second antenna volume of the body and adjacent to the first antenna volume, configured to operate at a fourth resonant frequency range that is greater than the first resonant frequency range.

7. The device of claim 6, wherein the fourth antenna port is further configured to couple the one or more communication signals with a cellular high band antenna comprising:

a monopole resonating element;

a parasitic resonating element; and a coupler element configured to couple the monopole resonating element and the parasitic resonating element and control an operational frequency range of the high band antenna component within the fourth resonant frequency range.

8. The device of claim 6, further comprising:

a parallel resonator comprising an inductor and a capacitor, coupled to the first antenna port and a ground plane of the first antenna volume, configured to facilitate a first antenna element coupled to the first antenna port to selectively resonate at a desired frequency within the first resonant frequency range and isolate a different desired frequency of the fourth resonant frequency range associated with the fourth antenna port from the second resonant frequency range comprising a WLAN frequency range, or an isolation element, located in the first antenna volume, configured to isolate the different desired frequency of the fourth resonant frequency range associated with the fourth antenna port and the second resonant frequency range.

9. The device of claim 6, wherein the first feed signal component comprises a dual coupling element configured to indirectly couple to a low band antenna of the first antenna port via the first coupler and directly couple to a cellular high band antenna of the fourth antenna port, or wherein the first feed signal component comprises the dual coupling element configured to indirectly couple to the low band antenna of the first antenna port via the first coupler and indirectly couple to a cellular high band antenna of the fourth antenna port via the third coupler.

10. The device of claim 1, further comprising:

a third volume of the body configured for an antenna diversity process comprising:

at least one additional first antenna port configured to operate at the first resonant frequency range of a low cellular frequency range;

at least one additional first coupler configured to indirectly couple the at least one additional first antenna port with an additional first feed signal component to transmit or receive the one or more communication signals at the first resonant frequency range;

at least one additional second antenna port configured to operate at second resonant frequency ranges of a WLAN frequency range; and at least one additional fourth antenna port configured to operate at a fourth frequency range of a high cellular frequency range and a mid-level frequency range that is directly coupled, or indirectly coupled, to the additional first feed signal component.

11. A system for transmitting or receiving one or more communication signals comprising:

a first antenna element coupled to a first antenna port, located in a first antenna volume of a body, configured to operate at a first resonant frequency range;

a first coupler configured to electromagnetically couple the first antenna element with a first feed signal component to transmit or receive the one or more communication signals at the first resonant frequency range;

a second antenna element coupled to a second antenna port, located in the first antenna volume of the body, configured to operate at a second resonant frequency range that is different than the first resonant frequency range; and a parallel resonator comprising a discrete inductor and a capacitor, coupled to the first antenna element and a ground plane of the first antenna volume, configured to facilitate the first antenna element to resonate at a desired frequency within the first resonant frequency range and isolate a different desired frequency of a fourth resonant frequency range associated with a fourth antenna element from the second resonant frequency range; or an isolation element, located within the first antenna volume of the body, configured to isolate operational frequencies of the second antenna element from operational frequencies of the fourth antenna element.

12. The system of claim 11, further comprising:

a third antenna element coupled to a third antenna port, located in the first antenna volume of the body and adjacent to the second antenna element, configured to operate at a third resonant frequency range that is different than the first resonant frequency range and the second resonant frequency range; and a second coupler configured to electromagnetically couple the second antenna element and the third antenna element with a second feed signal component to transmit or receive the one or more communication signals at the second resonant frequency range or the third resonant frequency range.

13. The system of claim 12, wherein the first coupler comprises a cellular low band coupler configured to resonate the first antenna element at a cellular low band antenna resonance of the first resonant frequency range that is lower than the second resonant frequency range and the third resonant frequency range.

14. The system of claim 11, further comprising:

a cellular high band antenna element as the fourth antenna element comprising:

a monopole resonating element;

a parasitic resonating element; and a coupler element configured to couple the monopole resonating element and the parasitic resonating element.

15. The system of claim 14, wherein the first coupler is further configured to directly couple the cellular high band antenna element with the first feed signal component to transmit or receive the one or more communication signals at the fourth resonant frequency range comprising about 1400 MHz to 2700 MHz or about 1400 MHz to 3800 MHz.

16. A communication system comprising:

a communication device, configured to transmit or receive one or more wireless communication signals, comprising:

a first antenna volume of a body comprising:

a low band antenna, located within a first subset of the first antenna volume, configured to transmit or receive one or more low band signals;

a first coupler configured to electromagnetically couple to the low band antenna to a first feed signal component;

a first WLAN antenna, located within the first subset of the first antenna volume, configured to transmit or receive one or more WLAN signals; and a high band antenna configured to transmit or receive one or more high band signals; and a second antenna volume, separate from and non-adjacent to the first antenna volume of the body, configured to facilitate an antenna diversity communication, comprising:

at least one additional low band antenna configured to transmit or receive the one or more low band signals at a lower frequency range than a frequency range of the high band antenna;

at least one additional first coupler configured to electromagnetically couple to the at least one additional low band antenna;

at least one additional WLAN antenna configured to configured to transmit or receive the one or more WLAN signals; and at least one additional high band antenna configured to transmit or receive the one or more high band signals.

17. The communication system of claim 16, wherein the high band antenna is located adjacent to the low band antenna along an edge of the body in a second subset of the first antenna volume.

18. The communication system of claim 16, wherein the high band antenna is further configured to operate in a wider high frequency range than the at least one additional high band antenna that includes the one or more high band signals and a mid-level frequency range in a resonant frequency range.

19. The communication system of claim 16, wherein the high band antenna comprises: a monopole resonating element; a parasitic resonating element; and a coupler element configured to couple the monopole resonating element and the parasitic resonating element to control an operational frequency range of the cellular high band antenna based on a relative distance between the monopole resonating element and the parasitic resonating element.

20. The communication system of claim 16, further comprising: a parallel resonator comprising a discrete inductor and a capacitor, located within the first subset of the first antenna volume, coupled to the low band antenna and a ground plane of the first antenna volume, configured to facilitate the low band antenna to resonate at a desired frequency within a low band frequency range and isolate a high band frequency range of the high band antenna from a WLAN frequency range of the first WLAN antenna; or an isolation element, located within the first subset of the first antenna volume, configured to isolate the high band frequency range of the high band antenna from the WLAN frequency range of the first WLAN antenna.

21. The communication system of claim 16, wherein the first feed signal component comprises a dual coupling element configured to indirectly, or directly, couple the low band antenna to a communication component via the first coupler, and, directly or indirectly, couple the high band antenna to the communication component.

* * * * *